US012736252B2

(12) United States Patent
Sceats

(10) Patent No.: US 12,736,252 B2
(45) Date of Patent: Sep. 15, 2026

(54) SOUND MUFFLER DEVICE FOR RESIDENTIAL DUCTWORK SYSTEM

(71) Applicant: Derek J Sceats, Renton, WA (US)

(72) Inventor: Derek J Sceats, Renton, WA (US)

( * ) Notice: Subject to any disclaimer, the term of this patent is extended or adjusted under 35 U.S.C. 154(b) by 307 days.

(21) Appl. No.: 18/429,762

(22) Filed: Feb. 1, 2024

(65) Prior Publication Data

US 2025/0251172 A1 Aug. 7, 2025

(51) Int. Cl.
*F24F 13/24* (2006.01)
*G10K 11/16* (2006.01)

(52) U.S. Cl.
CPC ..... *F24F 13/24* (2013.01); *F24F 2013/242* (2013.01)

(58) Field of Classification Search
CPC ..... F24F 13/24; F24F 13/02; F24F 2013/242; B60H 1/00507; B60H 2001/006; Y10S 454/906; G10K 11/16; G10K 11/161
See application file for complete search history.

(56) References Cited

U.S. PATENT DOCUMENTS 1,033,963 A * 7/1912 Surprise ..... F24F 13/24 454/251
2,176,319 A * 10/1939 Anderson ..... F24F 13/24 454/262
2,704,504 A * 3/1955 Wilkening ..... F24F 13/24 454/906
2,950,776 A * 8/1960 Stephens ..... F24F 13/24 181/224
3,378,100 A * 4/1968 Welty ..... F24F 13/24 181/224
4,050,364 A * 9/1977 Maus ..... F24F 7/00 181/224
4,485,730 A * 12/1984 Baus ..... F24F 13/24 454/274
4,560,320 A * 12/1985 Baus ..... F24F 7/013 138/155

(Continued)

FOREIGN PATENT DOCUMENTS

CA 3095281 A1 * 4/2022 ..... F16L 55/0336
CN 202883055 U * 4/2013

(Continued)

*Primary Examiner* — Edgardo San Martin
(74) *Attorney, Agent, or Firm* — Alloy Patent Law; Walker Griffin Weitzel

(57) ABSTRACT

Provided is a sound muffler device and method for reducing sound transmission from a ductwork system. The sound muffler device acts as an insert insertable into a register vent of the ductwork system to reduce the sound transmitted out from the ductwork system. The sound muffler device includes a baffle housing having an inlet section, an outlet section, and baffle housing walls. The inner surfaces of each of the baffle housing walls are covered with sound-absorbing material. The sound muffler device further includes baffle plates configured within the baffle housing. The baffle plates are also covered with sound-absorbing material on either one side or both sides. The sound muffler device further includes a labyrinth channel through which the sound waves pass along with the flowing air. The sound absorbing material within the housing and around the baffle plates absorb the sound waves to lower the level of sound.

26 Claims, 10 Drawing Sheets

(56) References Cited

U.S. PATENT DOCUMENTS 4,582,164 A * 4/1986 Schreiner ..... F16L 55/02763 454/906
4,660,676 A * 4/1987 Eustace ..... F24F 13/24 454/906
5,274,201 A * 12/1993 Steele ..... F24F 13/24 181/267
5,728,980 A * 3/1998 Zarnick ..... F24F 13/0281 181/224
5,983,888 A * 11/1999 Anselmino ..... F04D 29/664 454/67
6,023,938 A * 2/2000 Taras ..... F24F 13/082 454/206
6,104,608 A * 8/2000 Casinelli ..... F24F 13/24 181/224
6,131,696 A * 10/2000 Esslinger ..... F04B 39/0055 181/224
6,953,104 B2 * 10/2005 Monson ..... E04F 17/04 454/262
8,480,461 B2 * 7/2013 Gruenberg ..... B60H 1/242 454/155
9,057,313 B2 * 6/2015 Heeb ..... F02M 35/1266
9,316,133 B2 * 4/2016 Schnitta ..... E04B 9/001
9,476,607 B2 * 10/2016 Gray ..... B32B 37/14
10,371,171 B2 * 8/2019 Cocks ..... H02P 23/00
10,490,178 B2 * 11/2019 Schnitta ..... E04B 9/006
11,353,239 B2 * 6/2022 Bouche ..... G10K 11/162
11,359,828 B2 * 6/2022 Emmons ..... F24F 11/0001
11,835,253 B2 * 12/2023 Sugawara ..... G10K 11/161
2009/0133957 A1 * 5/2009 Owens ..... E04F 17/04 181/224
2015/0101883 A1 * 4/2015 Xu ..... F24F 13/082 181/224

FOREIGN PATENT DOCUMENTS

CN 109882451 A * 6/2019
CN 111795012 A * 10/2020 ..... F04D 29/403
CN 211777898 U * 10/2020
DE 2365782 A1 * 4/1976
DE 2830606 A1 * 1/1980
DE 2854266 A1 * 6/1980
DE 19623708 C1 * 12/1997 ..... F24F 8/10
DE 10059077 B4 * 7/2015 ..... F24F 13/28
EP 0095752 A1 * 12/1983 ..... F24F 13/24
JP 63120809 A * 5/1988
JP H09119703 A * 5/1997
JP H09217480 A * 8/1997
JP 2005104169 A * 4/2005
JP 2007168681 A * 7/2007

* cited by examiner

SOUND MUFFLER DEVICE FOR RESIDENTIAL DUCTWORK SYSTEM

TECHNICAL FIELD

The present invention generally relates to the field of attenuating sound. More particularly, the present invention relates to a sound-reducing device adapted for attenuating sound transmitted through vents of ductwork that open to one or more rooms in a house or building. The sound-reducing device is intended to reduce noise both entering and leaving the ductwork.

BACKGROUND

FIG. 1 shows an exemplary traditional HVAC ductwork system 10 of a residential house. In conveying heated or cooled air from a furnace 101 or an air conditioner in such system 10, the air is usually conducted to a rectangular cross-section main duct 101*a* and thereafter through branch ducts 101*b* that extend from the main duct 101*a*. These branch ducts 101*b* are formed or extend from sealed circular cross-section sheet metal pipe. These branch ducts 101*b* then carry the conditioned air to sidewall registers or ceiling registers or floor registers that open into rooms as register vents 101*c* in the house to permit circulation of the conditioned air within the rooms. However, most of these residential HVAC systems are noisy and significantly impact the overall comfort and well-being of residents. Besides being a nuisance, the sound from traditional HVAC ductwork can disrupt sleep, hinder productivity, and create an unpleasant living environment. Prolonged exposure to high levels of sound from noisy ductwork systems can lead to stress, and other health issues.

Traditionally, cylindrical silencers or resonators are used to reduce sound traveling through ductwork and are installed permanently in the ductwork. Ideally, these silencers or resonators are installed at the time of construction itself. If someone plans to have such solutions installed for reducing the sound from the ductwork then one needs to remove drywall to access the ductwork for installation of these silencers or resonators and then reinstall the drywall. Some people use homemade solutions made using plywood. These solutions are usually permanently installed and are intended to reduce sound traveling into the room through the vent, however are not very effective and costly.

Uninsulated or poorly insulated ductwork is a common cause of sound from residential ductwork. The vibrations and airflow within the ducts can create audible sounds throughout the home. Timely cleaning and maintenance activities such as tightening loose components, and properly insulating ductwork can reduce sound transmission from the ductwork.

Additionally, installing the HVAC ductwork in isolated areas, away from occupied spaces (such as offices, classrooms, or bedrooms), and choosing HVAC ductwork with built-in vibration isolation mechanisms to minimize sound caused by mechanical movements are some of the possible solutions to mitigate the sound from the residential HVAC ductwork systems. However, relocating or isolating ductwork from existing facilities where the ductwork is already installed is a costly affair for users to adapt to. Again, replacing existing ductwork that may be generating higher sound with a new ductwork system with a built-in vibration isolation mechanism can prove to be a costly.

Several attempts have been made in the past by inventors for sound reduction through HVAC ductwork, for instance, U.S. Pat. No. 4,582,164 discloses a method and apparatus for sound reduction to reduce the equipment room source sound to an acceptable level at points exterior to the equipment room. As disclosed in the patent, to achieve sound reduction, the ductwork located within the equipment room is made of a lighter gauge material to facilitate radiation of sound back into the equipment room. The flow is divided into a plurality of duct passages within the duct to achieve sufficient attenuation. Each of the duct passages is lined on all sides so that there is a double thickness of acoustic insulation between adjacent duct passages.

U.S. Pat. No. 10,371,171 discloses a system and method for reducing sound in an air moving system. This patent discloses a centrifugal blower system that includes a centrifugal blower assembly for generating airflow. The centrifugal blower assembly includes a housing, a motor coupled to the housing, and at least one impeller coupled to the motor. A motor controller is coupled to the motor. The motor controller is configured to receive at least one feedback parameter and to transmit instructions to the motor to control an operation of the motor based on the at least one feedback parameter. The operation of the motor is configured to reduce sound in the centrifugal blower system. Further, U.S. Pat. No. 11,359,828 discloses about a modular damper system is configured for installation in a ductwork of a building that supplies conditioned air through a register vent of the building.

The existing solutions related to sound reduction from the HVAC ductwork system are ineffective, have some design flaws, are difficult to install without special expertise, are costly, and are complex in use. Thus, there remains a need for a simple, effective, efficient, cost-effective sound-reducing device for ductwork systems capable of solving the aforementioned problems of the existing solutions. The proposed sound-reducing device significantly reduces the sound transmission through the ductwork in general and is not just limited to its use with HVAC systems. The invention is intended to reduce noise both entering and leaving the ductwork.

SUMMARY

Before the present systems, methods, and embodiments are described, it is to be understood that this application is not limited to the particular systems, and methodologies described, as there can be multiple possible embodiments that are not expressly illustrated in the present disclosures. It is also to be understood that the terminology used in the description is for the purpose of describing the particular versions or embodiments only, and is not intended to limit the scope of the present application. Further, it is also to be understood that the terminology if not defined by the present disclosure should be construed as the general or known meaning/definition of the terminology, known to the person skilled in the art.

It is an object of the present invention to provide a sound-reducing device adapted for attenuating sound emitted through vents of residential ductwork. The sound-reducing device is easily installable into the floor, ceiling, or sidewall registers of a facility (Eg. bedroom). The sound-reducing device provides improved comfort and sleep, enhanced productivity, and better health to users.

It is an object of the present invention to provide a sound muffler device or sound-reducing device that significantly reduces sound levels traveling through residential ductwork, both into and out of rooms of a house with vents. The proposed invention can be installed by any homeowner under the existing vents of the ductwork system of their home without the need for any special tools or cutting through drywall.

Additionally, the proposed sound muffler device is removably insertable into the vent (to rest inside the register of the ductwork), this allows easy access to the ductwork for cleaning and maintenance work with minimal inconvenience to the maintenance professionals.

Embodiments of the present invention disclose a sound muffler device adapted for use with a ductwork system of a house. The sound muffler device includes a baffle housing having an inlet section, and an outlet section, the baffle housing comprising at least a top housing wall, a bottom housing wall, a front housing wall, a first rear housing wall, a second rear housing wall, and a pair of lateral side walls. The inner surfaces of each of the top housing wall, the bottom housing wall, the front housing wall, the first rear housing wall, the second rear housing wall, and the pair of lateral sides are covered with sound-absorbing material.

In an embodiment, the inlet section extends from an end of the bottom housing wall to an end of the first rear housing wall, and the outlet section is configured on the top housing wall opposingly positioned to the bottom housing wall.

According to the embodiment, the sound muffler device further comprises at least one first baffle plate, and at least one second baffle plate configured within the baffle housing. Each of the first baffle plate, and the second baffle plate is covered with the sound-absorbing material on either one side or both sides.

According to the embodiment, the sound muffler device further comprises a labyrinth channel formed within the baffle housing, wherein the air and sound traveling through the ductwork system of the house passes through the inlet section to the outlet section and out from a register vent is absorbed by the sound-absorbing material without restricting airflow within the ductwork system.

In an embodiment, each of the at least one first baffle plate is coupled to the inner surface of the front housing wall, and each of the at least one second baffle plate are distanced apart and coupled to the inner surface of the first rear housing wall. Further, each of the at least first baffle plate, and the at least second baffle plate is alternatively disposed on the inner surfaces of the front housing wall, and the first rear housing wall to form the labyrinth channel.

DETAILED DESCRIPTION

Before describing the present invention in detail, it should be observed that the present invention utilizes a combination of components or processes, which constitutes a sound reducing device designed for the home ductworks for reducing sound level traveling out of the vents. Accordingly, the components or processes have been represented, showing only specific details that are pertinent for an understanding of the present invention so as not to obscure the disclosure with details that will be readily apparent to those with ordinary skill in the art having the benefit of the description herein. As required, detailed embodiments of the present invention are disclosed herein; however, it is to be understood that the disclosed embodiments are merely exemplary of the invention, which can be embodied in various forms. Therefore, specific component-level details and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Some embodiments, illustrating its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise. Although any methods, and systems similar or equivalent to those described herein can be used in the practice or testing of embodiments, the preferred methods, and systems are now described. The disclosed embodiments are merely exemplary.

References to "one embodiment", "an embodiment", "another embodiment", "one example", "an example", "another example" and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment. The words "comprising", "having", "containing", and "including", and other forms thereof, are intended to be equivalent in meaning and be open-ended in that an item or items following any one of these words is not meant to be an exhaustive listing of such item or items or meant to be limited to only the listed item or items.

Figure 1:
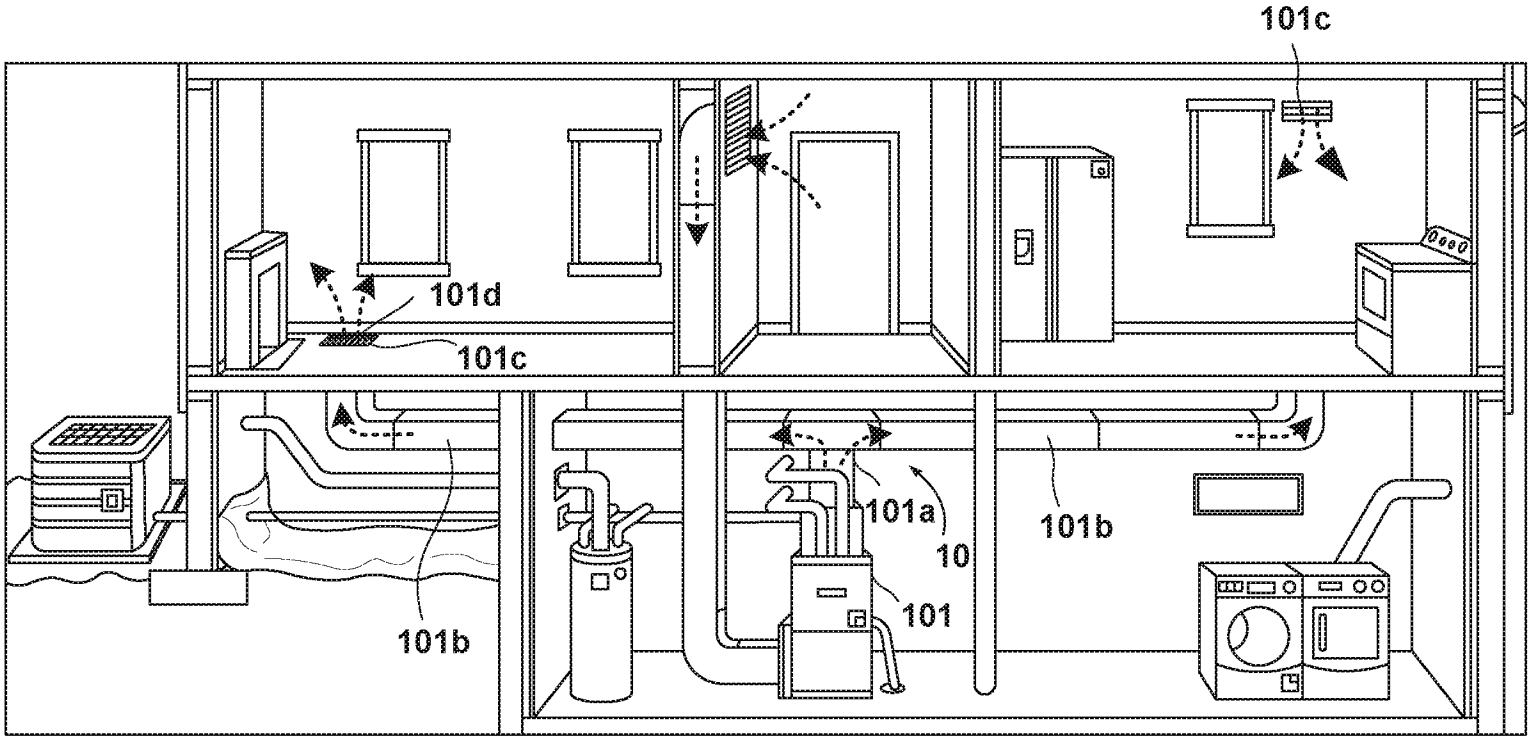
(Prior Art) FIG. 1
FIG. 1 illustrates an exemplary traditional HVAC ductwork system of a residential house.

Referring to FIG. 1, usually a HVAC system or a ductwork system 10 is installed in homes when the homes are built or after the home is built. The HVAC system 10 uses a furnace or air conditioning unit 101 that generates heated or cooled air that travels through the ductwork (duct pipes 101*a*, 101*b*) and reaches the home via register vents 101*c* covered with vent covers 101*d*. Although these ductwork systems allow conditioned air to travel therethrough, it is a notable fact that most of these ductwork employs a lot of instruments leading to the generation of a lot of unwanted sounds/noise that eventually travels through the ductwork and out through the register vents 101*c*. The register vents 101*c* may be in the floor, walls, or ceiling of the rooms. The sound/noise is usually disturbing and is undesirable by homeowners. Inventor herein proposes a simple, yet effective and reliable solution to mitigate the sound/noise coming out from the ductwork system or HVAC systems. Although FIG. 1 shows the sound muffler device can be utilized with respect to HVAC system, it should be understood that the sound muffler device is capable of significantly reducing the sound transmission through the ductwork in general. The invention is intended to reduce noise both entering and leaving the ductwork. For example, a baby sleeping in one room and noise in other areas of the house can be reduced by utilizing the proposed device. Likewise, the device can be utilized in ductwork to reduce loud music or TV impacting people seeking quiet or sleep.

The sound muffler device or sound-reducing device and various embodiments of the present invention will now be described with reference to the accompanying drawings, particularly FIGS. 1-18.

Referring to FIGS. 2-4 and FIGS. 11-12, and 14-15 that illustrate a preferred embodiment of the present invention. The sound muffler device or a sound reducing device 100 of the present invention is adapted for use with a ductwork system 10. The sound muffler device 100 includes a housing 102, herein referred to as a baffle housing 102. The baffle housing 102 is shaped in a cuboidal box-like structure with its bottom wall 103 and rear wall 105 truncated and connected using an additional wall 104. The same will be understood in the description to follow. Particularly, the baffle housing 102 includes a top housing wall 107, a bottom housing wall 103, a front housing wall 110, a first rear housing wall 105, a second rear housing wall 104, and two lateral side walls 106. These walls 103,104,105,106, 107, 110 are attached forming the baffle housing structure 102 according to one embodiment. The attachment may be carried out using welding or a like mechanism. In another embodiment, a single metal sheet may be properly folded to give it the shape of the housing structure 102. Also, although it is preferred that a metal sheet is used to form the baffle housing 102, it should be understood that any other material durable in nature and able to withstand the pressure, heat, etc. within the ductwork may be used as a substitute material for forming the baffle housing 102.

Although, the preferred embodiment describes the baffle housing 102 having the top housing wall 107, the bottom housing wall 103, the front housing wall 110, the first rear housing wall 105, the second rear housing wall 104, and the two lateral side walls 106. It should be understood that the housing 102 may be customized by eliminating one or more of these baffle housing walls depending upon the duct pathway or the register vent's orientation where the proposed invention 100 is inserted to reduce the noise/sound.

Figure 2:
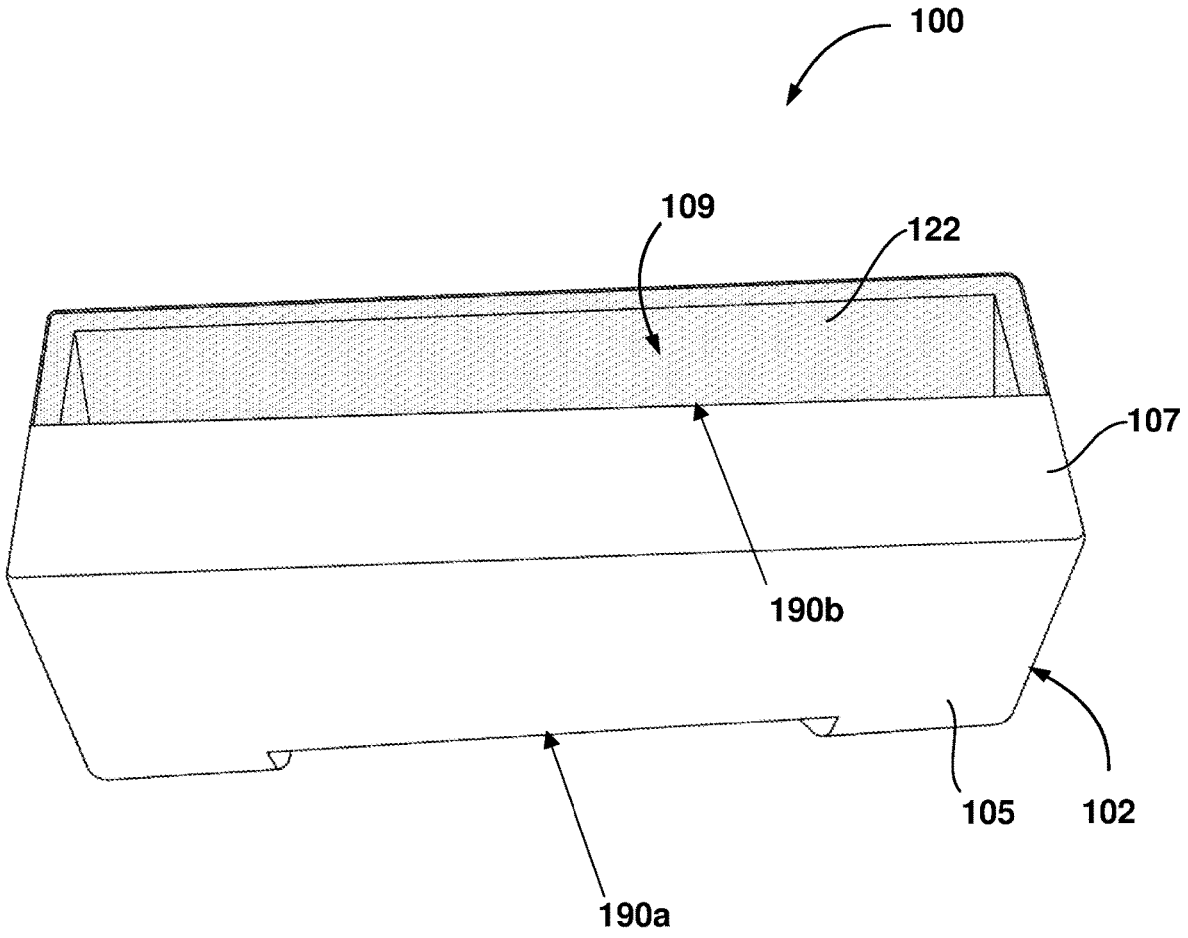
FIG. 2 illustrates a top-back perspective view of a sound-reducing device/a sound muffler device for a residential ductwork system, according to an exemplary embodiment of the present invention.
Figure 3:
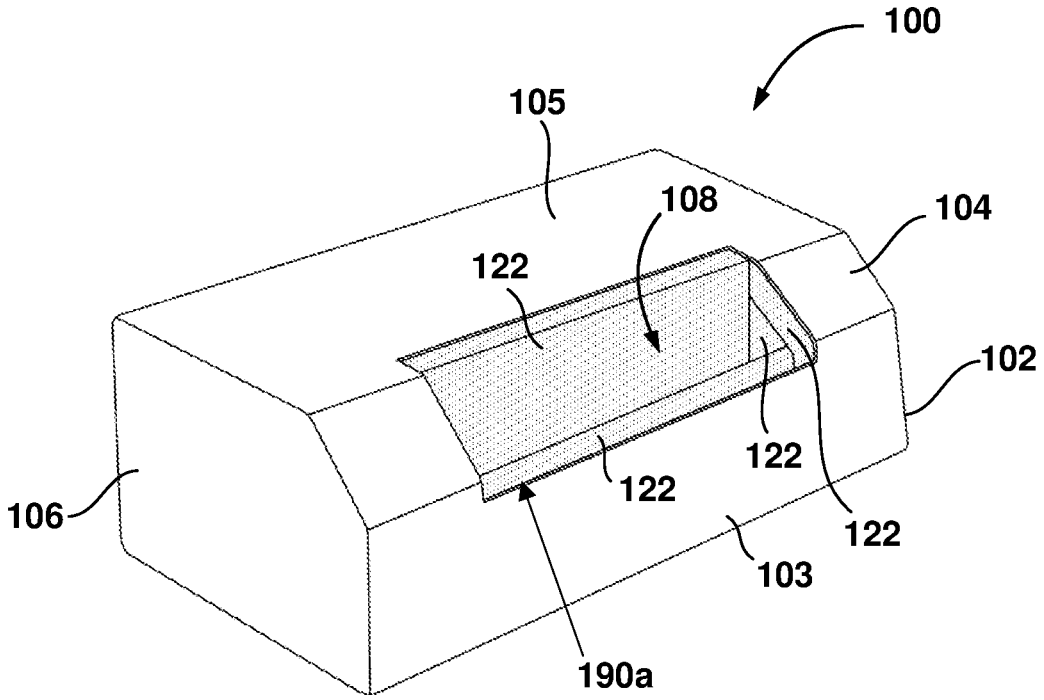
FIGS. 3 and 4 illustrate bottom-back perspective views of the sound-reducing device of FIG. 1.
Figure 4:
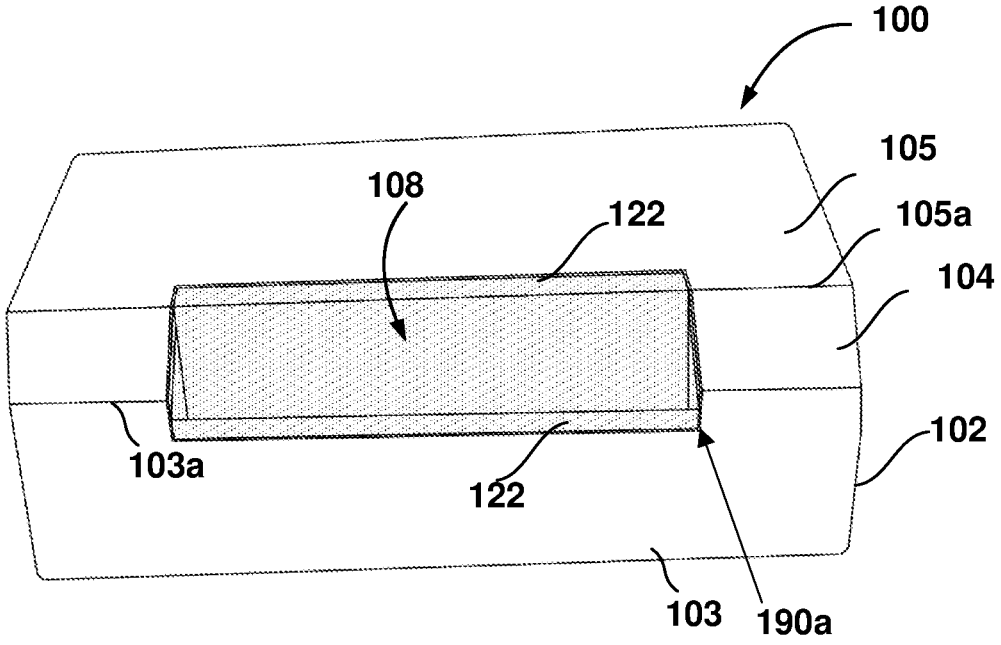

The functionality of the sound muffler device 100 doesn't essentially depend on the shape of the baffle housing 102. The shape of the baffle housing 102 as shown in the accompanying figures has the corner removed from the side cross-section (FIG. 2-4). This particular shape of the baffle housing 102 helps to simplify the installation of the muffler device 100 within the vent register 101*c*. Having the rectangle by the inlet section 108 and the angled portion created using the wall 104 pointing to the direction of the airflow minimizes accidental mis-installation of the device 100 by homeowners. So, the specific shape of the baffle housing 102 is for ease and accurate placement. Suitable changes to the shape of the housing 102 is possible without departing from the scope of the invention.

According to the embodiment, the baffle housing 102 houses at least one first baffle plate 120*a*, and at least one second baffle plate 120*b* there inside. In an embodiment, the at least one first baffle plate 120*a*, and at least one second baffle plate 120*b* are made using a metal sheet. However, it should be understood that the baffle plates 120*a*, 120*b* may be made using any other material suitable. Likewise, the baffle plates 120*a*, 120*b* are made with appropriate thickness given the limitation on the dimension of the housing 102 that's going to sit into the register vent 101*c*. Further, as seen, each of the first baffle plate 120*a* is distanced apart and coupled to the inner surface of the front housing wall 110, and each of the at least one second baffle plate 120*b* is distanced apart and coupled to the inner surface of the first rear housing wall 105.

Figure 12:
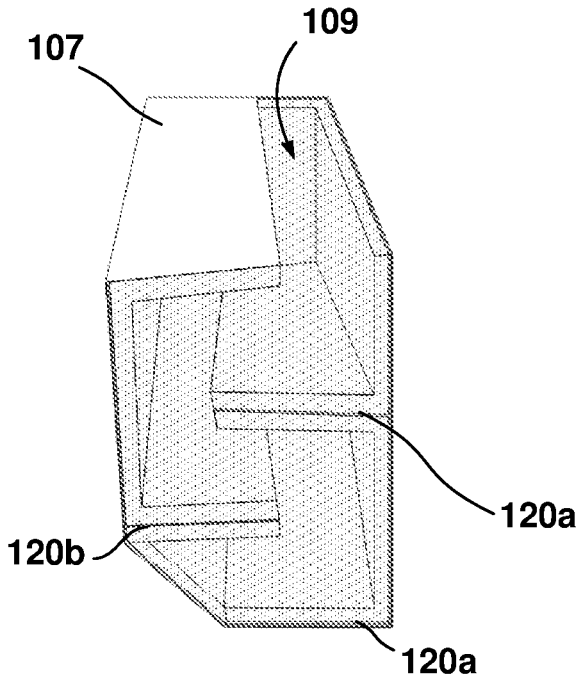
FIG. 12 shows a cross-sectional view of the sound-reducing device of FIG. 11 taken along AA.
Figure 13:
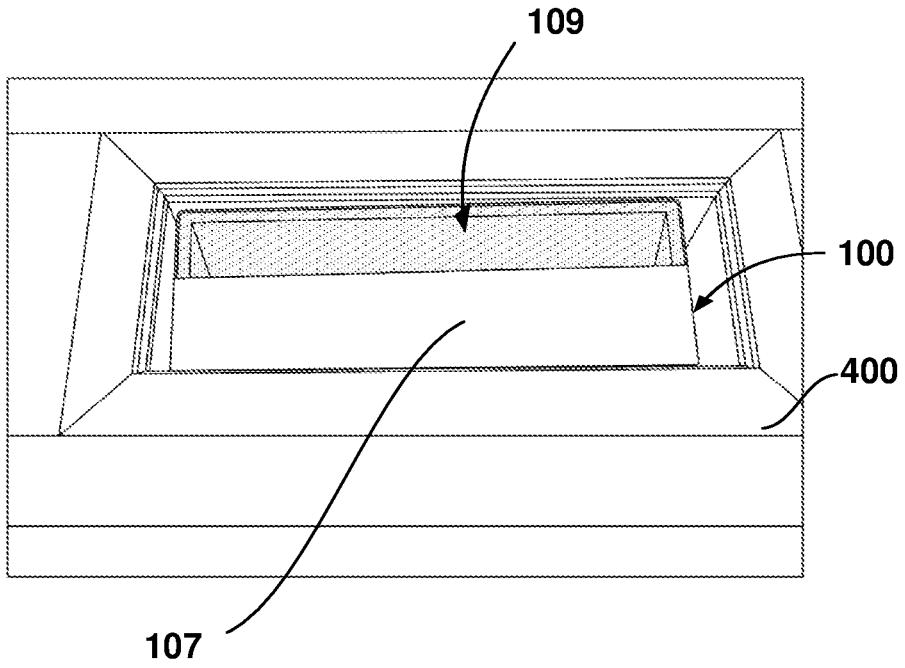
FIG. 13 shows the sound-reducing device of FIG. 2 installed in a typical floor register vent, according to an example embodiment.
Figure 15:
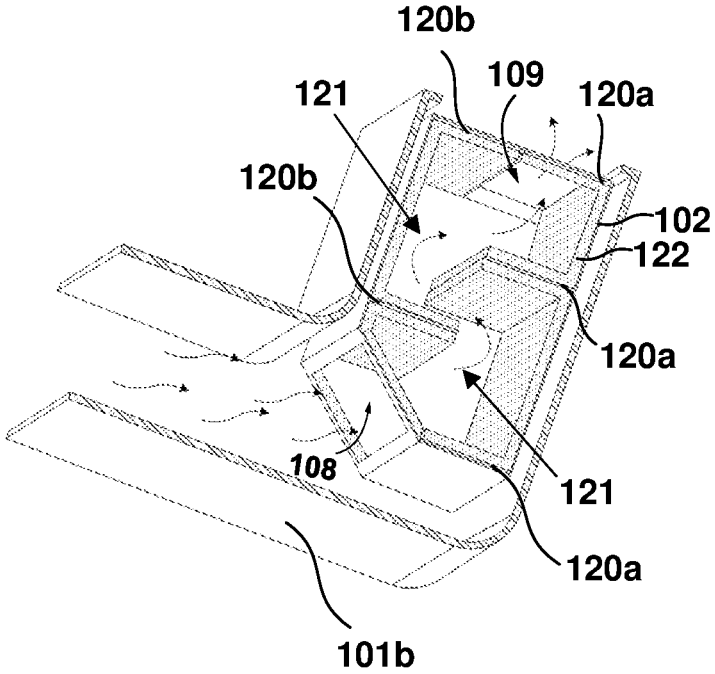
Figure 16:
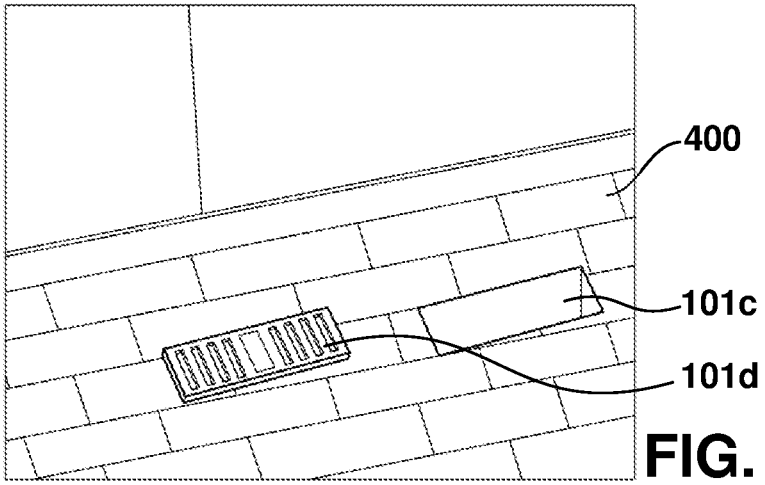
FIGS. 16-18 demonstrates the simplicity of use of the sound-reducing device of FIG. 2.

In the exemplary embodiment represented in the figures, two first baffle plates 120*a*, and two second baffle plates 120*b* are shown coupled to the front housing wall 110, and the first rear housing wall 105 respectively. It should be understood that any number of such baffle plates 120*a*, and 120*b* may be embodied inside the housing 102, In the current example embodiment, it is shown that there are an equal number of baffle plates 120*a* and baffle plates 120*b*, however, an equal number of baffle plates 120*a*, and baffle plate 120*b* is not an absolute requirement for the functioning of the device 100. Further, in an embodiment, each of the baffle plates 120*a* is equally spaced apart from each other and each of the baffle plates 120*b* is equally spaced apart from each other. Farther, in another embodiment, each of the baffle plates 120*a* may not be equally spaced apart from each other and each of the baffle plates 120*b* may not be equally spaced apart from each other. Additionally, in the embodiment, each of the at least first baffle plate 120*a*, and the at least second baffle plate 120*b* is alternatively disposed on the inner surfaces of the front housing wall 110, and the first rear housing wall 105 to form a labyrinth channel 121 (FIGS. 12 and 15). In the embodiment, each of the at least first baffle plate 120*a*, and the at least second baffle plate 120*b* is covered with the sound-absorbing material 122 on either one side or both sides of the respective baffle plates 120*a*, 120*b*.

Figure 14:
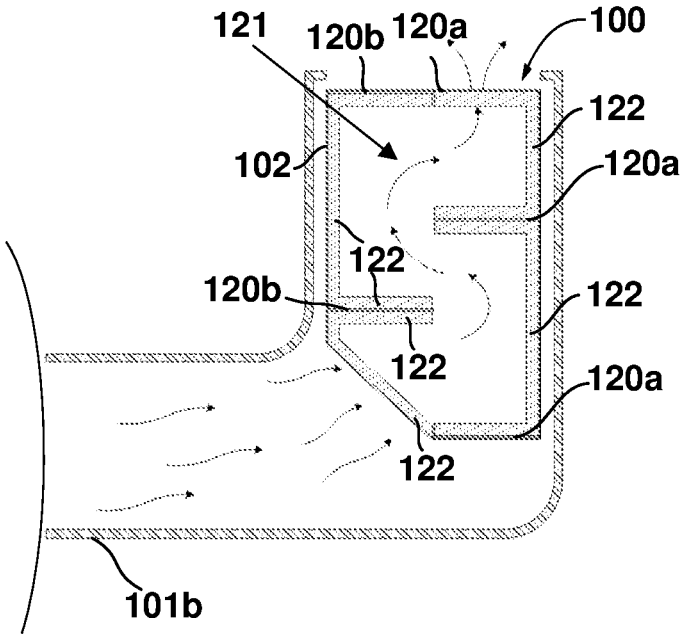
FIGS. 14 and 15 illustrate the operation of the sound-reducing device of FIG. 2 while it is installed within a register head (a floor register) of the ductwork of the house.

According to an embodiment, the at least one first baffle plate 120*a*, and the at least one second baffle plate 120*b* may have the same orientations to the front housing wall 110, and the first rear housing wall 105 respectively. For example, the baffle plates 120*a*, and 120*b* may all extend perpendicularly or angularly (at any other angle) from the housing wall 110 and the housing wall 105. The accompanying figures show the baffle plates 120*a*, and 120*b* extend perpendicular to the housing walls 110,105 (FIGS. 12,14 and 15). In another embodiment (not seen), the baffle plates 120*a*, 120*b* may have different orientations with respect to the housing wall 110, and the housing wall 105 respectively from which they extend. For example, some of the baffle plates 120*a*, 120*b* may be perpendicularly oriented or oriented at different angles with respect to the walls 110,105.

In an embodiment, as seen in accompanying figures, particularly FIGS. 12,14-15, the first baffle plate 120*a*, and the second baffle plate 120*b* have substantially the same shape. The first baffle plate 120*a*, and the second baffle plate 120*b* extend along the entire length of the sound muffler device 100. In another embodiment (not seen), the first baffle plate 120*a*, and the second baffle plate 120*b* have different shape and extend along the partial length of the muffler device 100.

Further, according to the embodiment, the inner surfaces of each of the top housing wall 107, the bottom housing wall 103, the front housing wall 110, the first rear housing wall 105, the second rear housing wall 104, and the two lateral side walls 106 are covered with sound-absorbing material 122. For example, an acoustic foam capable of absorbing sound traveling through the ductwork may be used. The acoustic foam is chosen with appropriate thickness and noise reduction coefficient. The acoustic foam in many different varieties can be chosen for this invention. The acoustic foam shaped like a wedge, pyramid, square grid, quadratic residue, or plain may be used. Any conventional acoustic foams available in the marketplace can be utilized, for example, but not limited to acoustic foams available under the brand names Nankarrow ProMax™, Nankarrow Neocurve™ etc. capable of effectively absorbing the sound within the ductwork 10 can be used.

According to the embodiment, the baffle housing 102 further comprises a cutout section 190*a* referred to as an inlet section 108, and a cutout section 190*b* referred to as an outlet section 109. The inlet section 108 extends from an end 103*a* of the bottom housing wall 103 to an end 105*a* of the first rear housing wall 105. In other words, the inlet section 108 is located between the bottom housing wall 103 and the rear housing wall 105 The outlet section 109 is configured on the top housing wall 107 opposingly positioned to the bottom housing wall 103.

In operation, the sound generated and traveling through the ductwork system 10 of the house passes through the inlet section 108 into the labyrinth channel 121 and then to the outlet section 109, and out from a register vent 101*c* is absorbed by the sound-absorbing material 122 configured within the housing 102. In other words, the inlet section 108 allows the conditioned air and sound/noise in the ductwork to enter into the baffle housing 102 which then pass through the labyrinth 121. The outlet section 109 allows the air to pass out of the housing 102 without imposing significant restrictions to the airflow (or causing minimal impact or minimal restriction to the airflow) and allows some or a negligible amount of sound waves to pass out of the housing 102 after most of the sound waves are absorbed within the housing 102 by the sound absorbing material 122.

Figure 7:
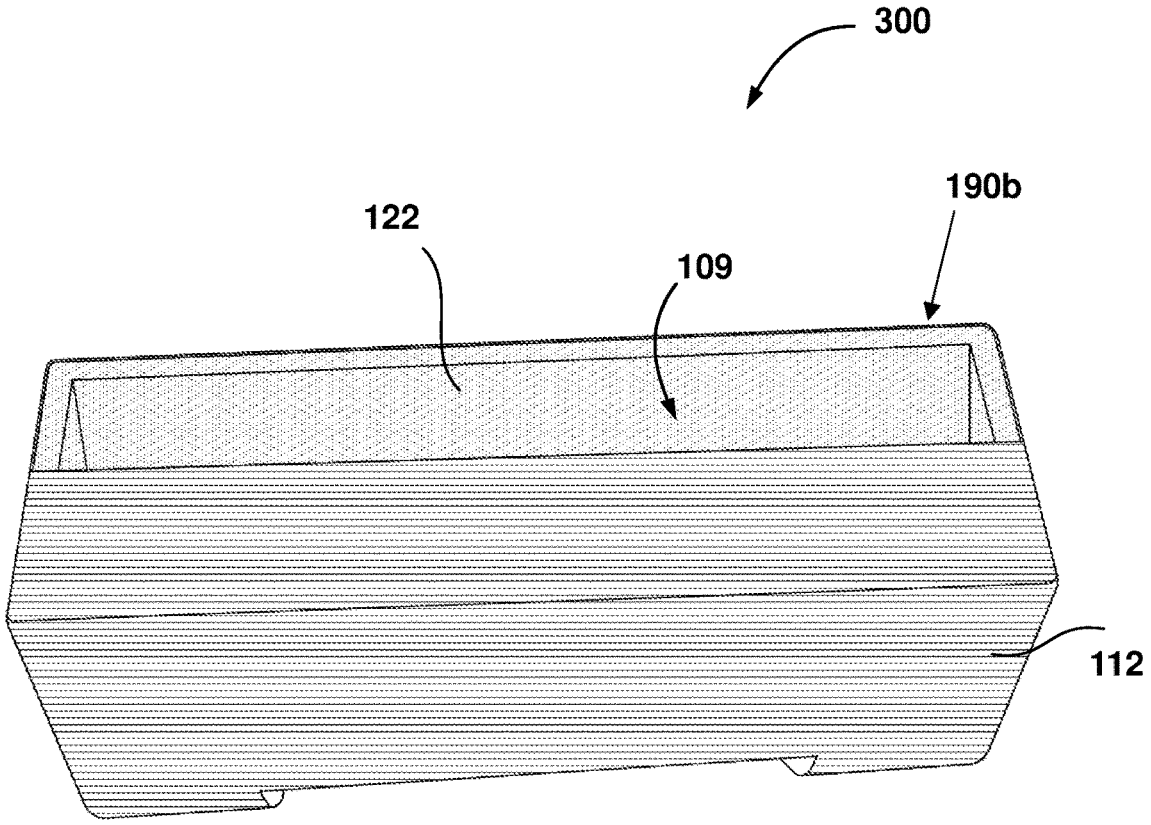
FIGS. 7 and 8 illustrate a top-back perspective view, and a bottom-back perspective view of the sound-reducing device, respectively with an external skirt covering a baffle housing of the sound-reducing device illustrated in FIGS. 2 and 4, according to another exemplary embodiment of the present invention.
Figure 8:
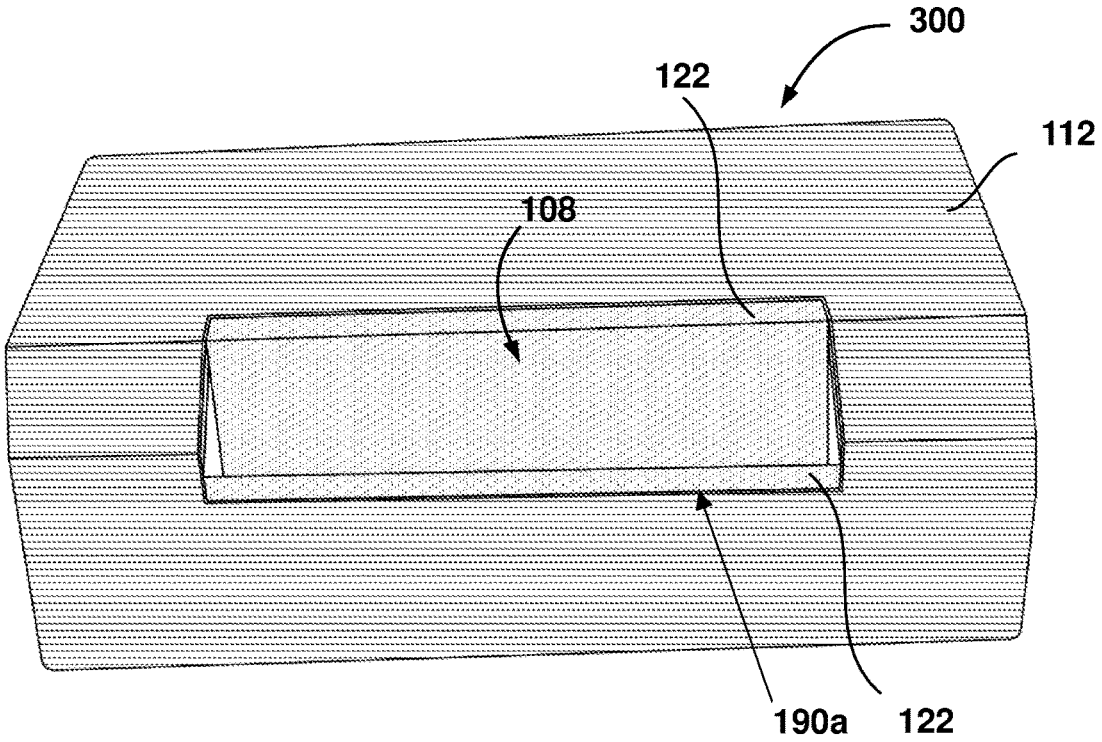
Figure 9:
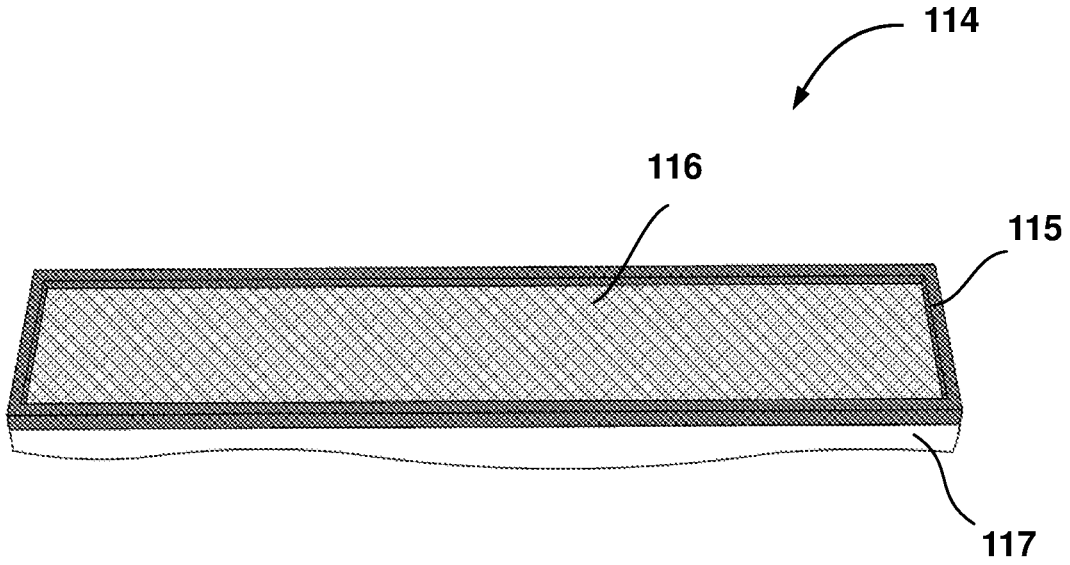
FIGS. 9 and 10 show a top perspective view and a bottom view of the outlet sealing cover of FIGS. 5-6.
Figure 10:
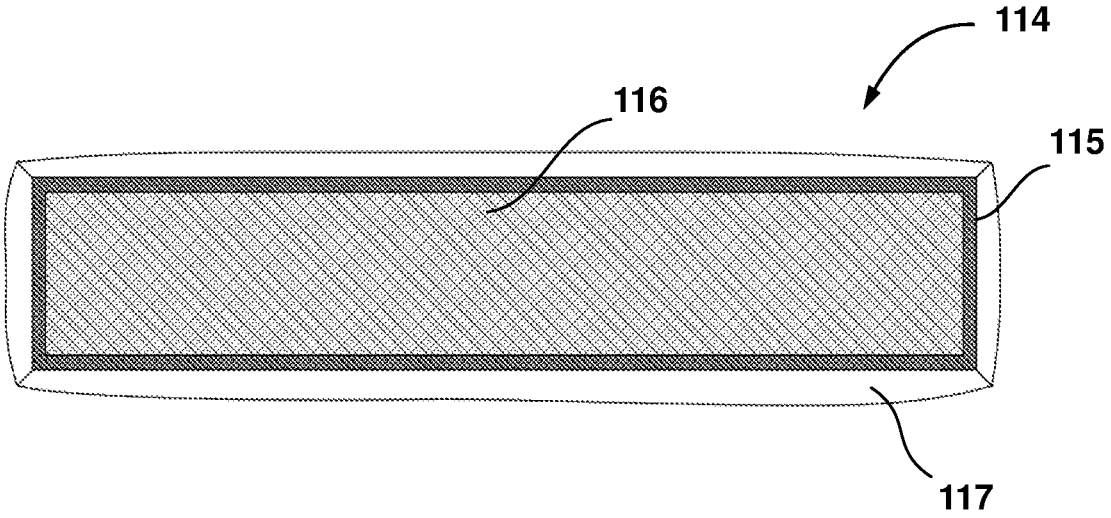
Figure 11:
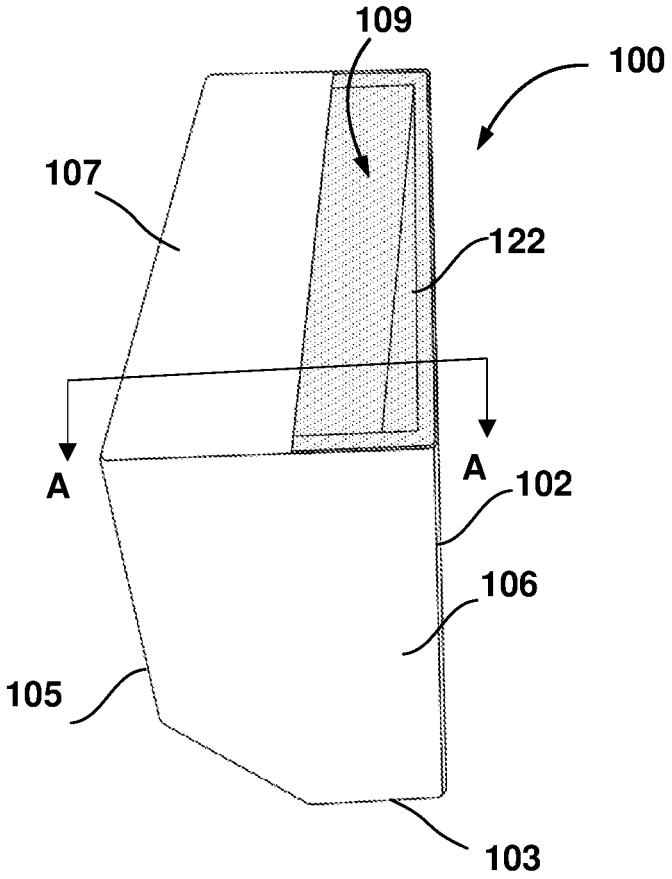
FIG. 11 shows a top-side perspective view of the sound-reducing device of FIG. 1.

Referring to FIGS. 7 and 8, shows an alternative embodiment of the sound reducing device shown in FIGS. 2 and 4. Particularly, the embodiment of FIGS. 7 and 8 is identical to the embodiment shown in FIGS. 2-4 and 11. FIGS. 7 and 8 show a top-back perspective view, and a bottom-back perspective view of the sound-reducing device, respectively with a skirt 112. The skirt 112 covers the baffle housing 102 externally. In other words, the skirt 112 covers the outer surfaces of each of the top housing wall 107, the bottom housing wall 103, the front housing wall 110, the first rear housing wall 105, the second rear housing wall 104, and the two lateral side walls 106. The external skirt 112 is preferably made of flexible and stretchable rubber material or the like. The skirt 112 acts like a sleeve that can cover the housing 102 and provide additional sealing to the sound generated by the ductwork system 10 and traveling through the housing 102. The skirt 112 further provides sealing against the debris present in the register vent 101*c* where the baffle housing 102 is installed. The external skirt 112 is preferably made of flexible material selected from a group of materials consisting of rubber, plastic, and fabric.

Figure 5:
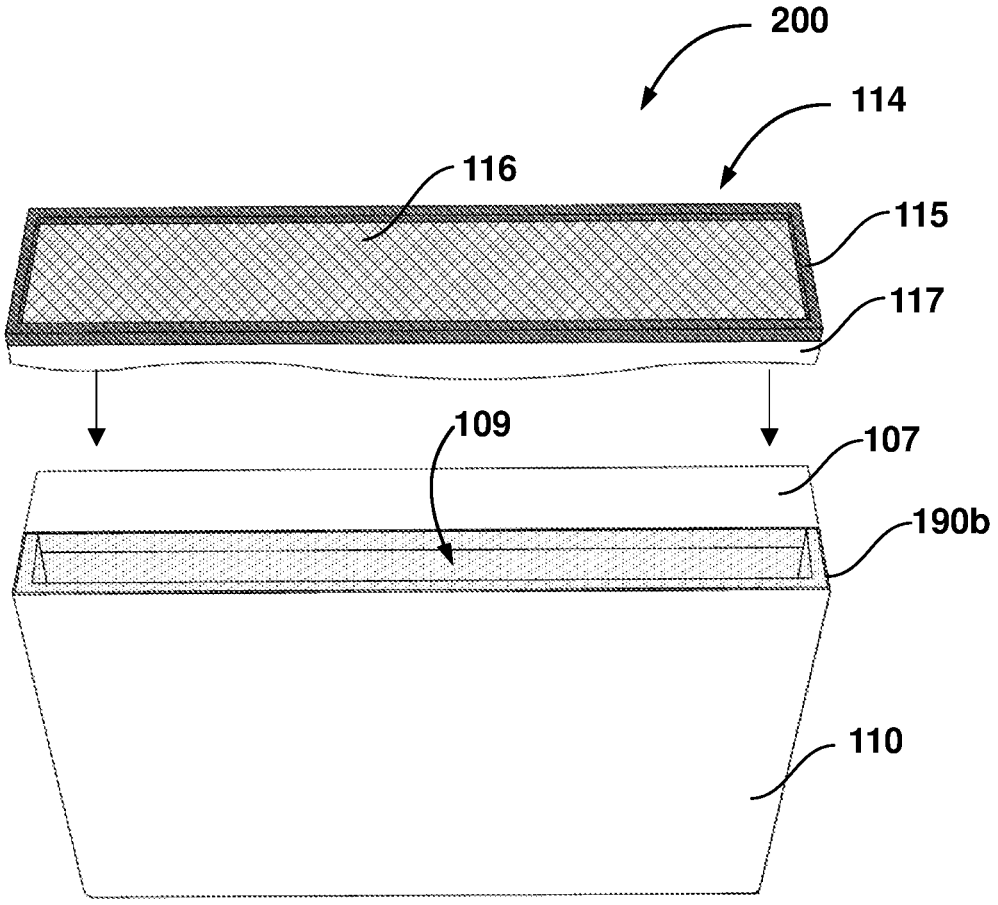
FIGS. 5 and 6 show an exploded view, and an assembled view of a sound-reducing device involving the use of an outlet sealing cover, according to another exemplary embodiment of the present invention.
Figure 6:
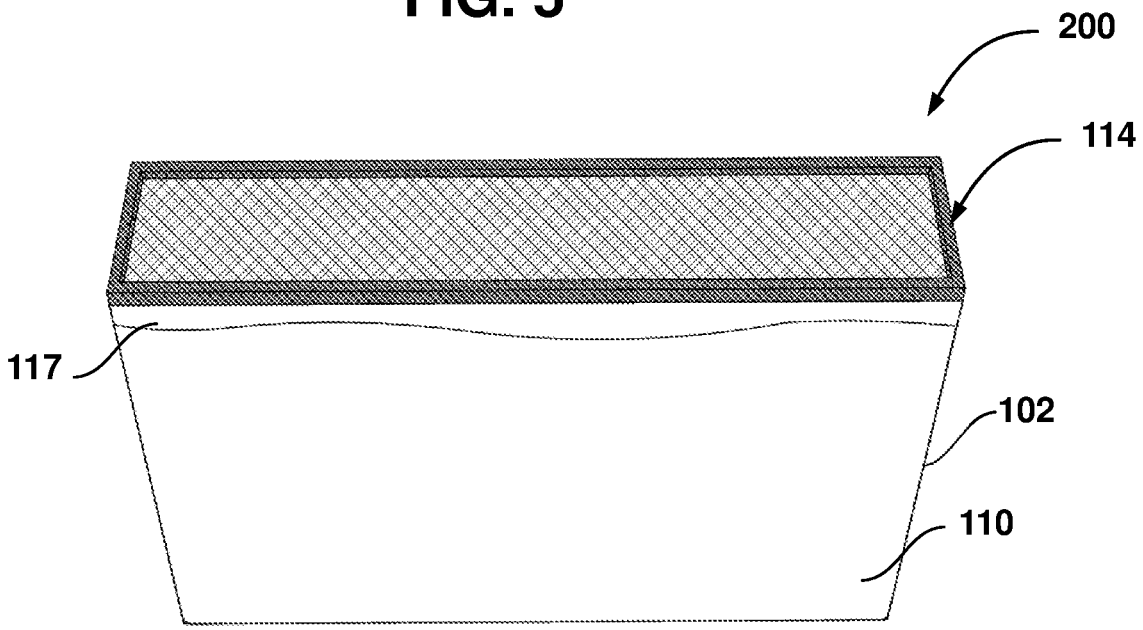

Referring to FIGS. 5 and 6 show an exploded view, and an assembled view of a sound-reducing device, according to another exemplary embodiment of the present invention. The embodiment shown in FIGS. 5 and 6 is essentially the same as the embodiment illustrated in FIGS. 2-4, however, the embodiment shown in FIGS. 5 and 6 involves the use of an outlet sealing cover 114. The outlet sealing cover 114 is adapted to cover the outlet section 109 and the top housing wall 107 of the baffle housing 102. In an embodiment, the outlet sealing cover 114 includes a frame 115, a mesh screen 116, and one or more flexible vanes 117. The frame 115 supports the mesh screen 116. The mesh screen 116 is adapted for capturing the debris entering the outlet section 109 of the sound muffler device 100. The flexible vanes 117 are attached to and extend from the frame 115. The flexible vanes 117 are stretchable for facilitating the engagement of the outlet sealing cover 114 on top of the sound muffler device 100.

Figure 17:
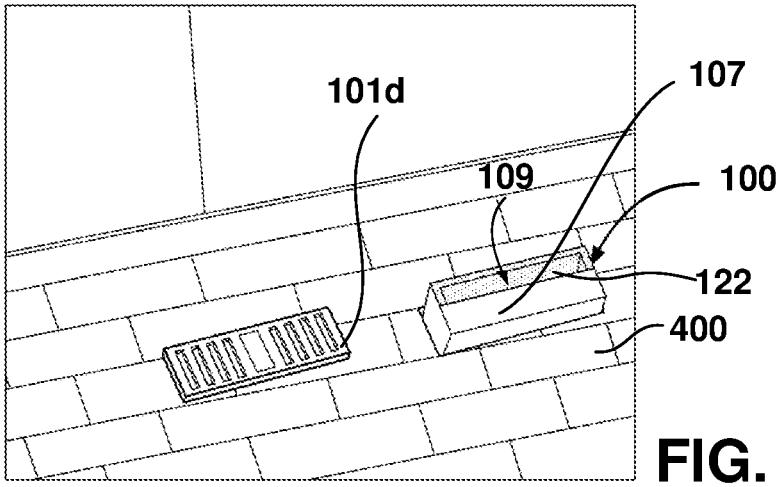
Figure 18:
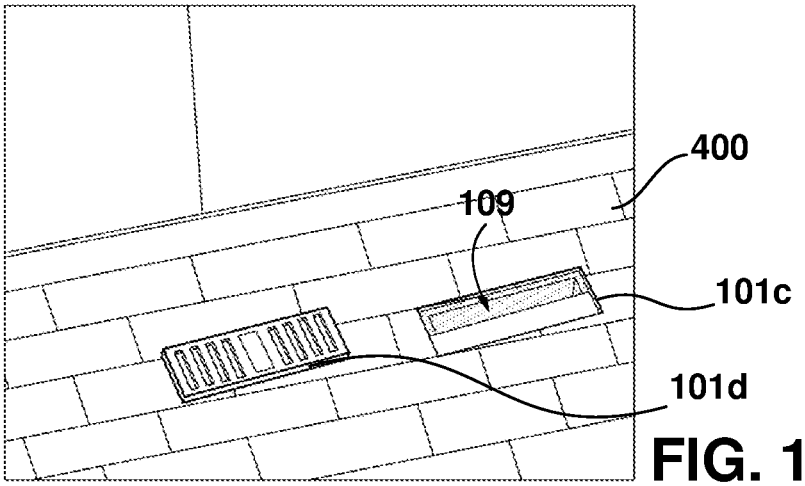

In operation, referring to FIGS. 13-18, in order to reduce sound transmission from a ductwork system of a house utilizing the sound-reducing device 100 of the present invention. For the use case, the preferred embodiment for the device 100 is considered. One can equally use alternative embodiments of the device 200 or 300 while installing the product into the register vent 101*c*. Firstly, a homeowner can dislocate or remove a vent cover 101*d* from the register vent 101*c* (FIG. 16) opening of the ductwork system 10 located on the floor 400 of a room. Next, the homeowner can insert the sound reducing device 100 into the cavity of the register vent 101*c* (FIG. 17). The sound muffler device 100 is inserted into the register vent 101*c* cavity such that the inlet section 108, and the bottom housing wall 103 of the sound muffler device 100 is operatively laid facing the duct lines 101*a*, 101*b* through which the sound generated in the ductwork system (10) travels (FIGS. 13-15 and 18). Next, the removed vet cover 101*d* is replaced on the register vent 101*c* after the installation of the device 100. As can be understood from FIGS. 14-15, the conditioned air along with sound/noise travels along the duct line 101*b*. Then the flowing air and sound waves enter the inlet section 108 of the housing 102 of the device 100 where the air and the sound are redirected and flow through the labyrinth 121 (indicated by arrow). The sound absorbing material 122 configured within the device 100 over the inner surfaces of the walls 107,103,110,105,104,106 and on the each of the baffle plates 120*a*, 120*b* absorb the sound to a great extent with minimal or negligible restriction to the airflow The amount of sound transmitted out of the vent 101*c* through outlet section 109 is substantially reduced in comparison when the device 100 is not deployed.

In the context of the present invention, the proposed sound muffler device 100,200,300 and associated components may be made in any dimension using a variety of materials. The dimensions of the device are chosen such as to complement the size and shape of the register vents where the device 100,200,300 is installed. During realizing the invention, the baffle housing 102 must be made slightly smaller than the rectangular vent in the floor or ceiling, which seems to be typically 3.75×11.25 inches or 3.75×9.25 inches. Additionally, the depth is typically less than 5 inches, which limits the dimensions of the housing 102 and number of baffle plates 120*a*, 120*b* housed within the baffler housing 102. For the product to function well, it is advised to maintain at least a 1-inch gap through the noise-reducing labyrinth, to prevent excessive back-pressure which could damage the furnace/air conditioning unit 101. Although the present invention has been described to be used with HVAC system of the homes, it should be noted that this could also be used with HVAC system installed in apartments or condominiums, or other similar facilities and is not restricted to residential houses It should be understood according to the preceding description of the present invention that the same is susceptible to changes, modifications and adaptations, and that the said changes, modifications and adaptations fall within scope of the appended claims.

What is claimed is:

1. A sound muffler device (100) adapted for use with a ductwork system (10) of a house, comprising:

a baffle housing (102) having an inlet section (108), and an outlet section (109), the baffle housing (102) comprising at least a top housing wall (107), a bottom housing wall (103), a front housing wall (110), a first rear housing wall (105), and a pair of lateral side walls (106), wherein inner surfaces of at least one of the top housing wall (107), the bottom housing wall (103), the front housing wall (110), the first rear housing wall (105), and the pair of lateral side walls (106) are covered with sound-absorbing material (122);

wherein, the inlet section (108) extends from an end (103*a*) of the bottom housing wall (103) to an end (105*a*) of the first rear housing wall (105), and the outlet section (109) is configured on the top housing wall (107) opposingly positioned to the bottom housing wall (103);

at least one first baffle plate (120*a*), and at least one second baffle plate (120*b*) are configured within the baffle housing (102), wherein each of the first baffle plate (120*a*), and the second baffle plate (120*b*) is covered with the sound-absorbing material (122) on either one side or both sides; and a labyrinth channel (121) formed within the baffle housing (102), wherein the sound muffler device (100) is removably insertable into the register vent (101*c*) to rest inside the register vent (101*c*) of the ductwork system (10), and wherein the air and sound entering and traveling through the ductwork system (10) passes through the inlet section (108) to the outlet section (109) and out from the register vent (101*c*) is absorbed by the sound-absorbing material (122) with minimal impact to airflow within the ductwork system (10).

2. The sound muffler device (100) of claim 1, wherein the baffle housing (102) further comprises a second rear housing wall (104).

3. The sound muffler device (100) of claim 1, wherein each of the at least one first baffle plate (120*a*) is located distanced apart and coupled to the inner surface of the front housing wall (110), and each of the at least one second baffle plate (120*b*) is located distanced apart and coupled to the inner surface of the first rear housing wall (105).

4. The sound muffler device (100) of claim 1, wherein each of the at least first baffle plate (120*a*), and the at least second baffle plate (120*b*) is alternatively disposed on the inner surfaces of the front housing wall (110), and the first rear housing wall (105) to form the labyrinth channel (121).

5. The sound muffler device (100) of claim 1, wherein the sound absorbing material (122) is an acoustic foam in at least plain, wedge, and pyramid shape known in the art.

6. The sound muffler device (100) of claim 1, wherein the sound muffler device (100) is inserted into the register vent (101*c*) such that the inlet section (108), and the bottom housing wall (103) of the sound muffler device (100) is operatively laid facing the duct lines (101*a*, 101*b*) through which the air and sound in the ductwork travel.

7. The sound muffler device (100) of claim 1, wherein the baffle housing (102) further embodies a skirt (112) covering the outer surfaces of each of the top housing wall (107), the bottom housing wall (103), the front housing wall (110), the first rear housing wall (105), and the pair of lateral side walls (106).

8. The sound muffler device (100) of claim 7, wherein the skirt (112) provides additional sealing to the sound traveling in the ductwork system (10), and sealing to the debris present in the register vent (101*c*) where the baffle housing (102) is installed.

9. The sound muffler device (100) of claim 1 further comprising an outlet sealing cover (114) adapted to cover the outlet section (109) and the top housing wall (107) of the baffle housing (102).

10. The sound muffler device (100) of claim 9, wherein the outlet sealing cover (114) comprises a frame (115) that supports a mesh screen (116) adapted for capturing the debris entering the outlet section (109) of the sound muffler device (100).

11. The sound muffler device (100) of claim 9, wherein the outlet sealing cover (114) further comprises one or more flexible vanes (117) attached to and extending from the frame (115) for facilitating the engagement of the outlet sealing cover (114) on top of the sound muffler device (100).

12. The sound muffler device (100) of claim 1, wherein the at least one first baffle plate (120*a*), and the at least one second baffle plate (120*b*) have the same orientations with respect to the front housing wall (110), and the first rear housing wall (105) respectively from which they extend.

13. The sound muffler device (100) of claim 1, wherein the at least one first baffle plate (120*a*), and the at least one second baffle plate (120*b*) have a substantially same shape.

14. The sound muffler device (100) of claim 1, wherein the at least one first baffle plate (120*a*), and the at least one second baffle plate (120*b*) extend partially or along the entire length of the sound muffler device (100).

15. The sound muffler device (100) of claim 1, wherein the at least one first baffle plate (120*a*), and the at least one second baffle plate (120*b*) have different orientations with respect to the front housing wall (110), and the first rear housing wall (105) respectively from which they extend.

16. The sound muffler device (100) of claim 1, wherein the at least one first baffle plate (120*a*), and the at least one second baffle plate (120*b*) have different shapes.

17. The sound muffler device (100) of claim 1, wherein the baffle housing (102), the at least one first baffle plate (120*a*), and at least one second baffle plate (120*b*) are made using a metal sheet.

18. The sound muffler device (100) of claim 7, wherein the external skirt (112) is made of flexible material selected from a group of materials consisting of rubber, plastic, and fabric.

19. A sound reducing device (100), comprising:

a baffle housing (102) having an inlet section (108), and an outlet section (109), the baffle housing (102) comprising at least a top housing wall (107), a bottom housing wall (103), a front housing wall (110), a rear housing wall (105), and a pair of lateral side walls (106) wherein inner surfaces of at least one of the top housing wall (107), the bottom housing wall (103), the front housing wall (110), the rear housing wall (105), the pair of lateral side walls (106) are covered with sound-absorbing material (122);

wherein, the inlet section (108) is located between the bottom housing wall (103) and the rear housing wall (105), and the outlet section (109) is configured on the top housing wall (107) opposingly positioned to the bottom housing wall (103);

at least one first baffle plate (120*a*), and at least one second baffle plate (120*b*) are configured within the baffle housing (102), wherein each of the first baffle plate (120*a*), and the second baffle plate (120*b*) is covered with the sound-absorbing material (122) on either one side or both sides; and a labyrinth channel (121) formed within the baffle housing (102), wherein the sound muffler device (100) is removably insertable into the register vent (101*c*) to rest inside the register vent (101*c*) of the ductwork system (10), and wherein the sound entering and traveling through the ductwork system (10) of a house passes through the inlet section (108) to the outlet section (109) and then out from a register vent (101*c*) is absorbed by the sound-absorbing material (122) with minimal impact to the airflow.

20. The sound reducing device (100) of claim 19 further comprising an outlet sealing cover (114) adapted to cover the outlet section (109), and the top housing wall (107) of the baffle housing (102).

21. The sound reducing device (100) of claim 19 further comprising an external skirt (112) covering the outer surfaces of the sound reducing device (100) for providing additional sealing to the sound generated by the ductwork system (10) and traveling therethrough, and sealing to the debris present in the register vent (101*c*) where the baffle housing (102) is installed.

22. A method for reducing sound transmission from a ductwork system of a house comprising the steps of:

dislocating, a vent cover (101*d*) from a register vent (101*c*) opening of the ductwork system (10);

inserting a sound muffler device (100) into the register vent (101*c*), the sound muffler device (100) being removably insertable into the register vent (101*c*) to rest inside the register vent (101*c*) of the ductwork system (10), the sound muffler device (100) comprising:

a baffle housing (102) having an inlet section (108), an outlet section (109), at least one baffle housing wall (107,103,110,105, 106), wherein the inner surfaces of at least one of the baffle housing wall (107,103, 110,105, 106) is covered with sound-absorbing material (122);

at least one first baffle plate (120*a*), and at least one second baffle plate (120*b*) configured within the baffle housing (102), wherein each of the first baffle plate (120*a*), and the second baffle plate (120*b*) is covered with the sound-absorbing material (122) on either one side or both sides;

a labyrinth channel (121) formed within the baffle housing (102); and passing the conditioned air along with the sound within the ductwork system (10) through the inlet section (108) to the outlet section (109) via the labyrinth channel (121) of the baffle housing (102) so that the sound gets absorbed by the sound-absorbing material (122) within the baffle housing (102).

23. The method of claim 22, wherein the insertion of the sound muffler device (100) into the register vent (101*c*) is such that the inlet section (108), and a bottom housing wall (103) of the at least one baffle housing wall (107,103,110, 105,106) is operatively laid facing the duct lines (101*a*, 101*b*) through which the sound within the ductwork system (10) travels.

24. The method of claim 22 further comprising a step of covering the outer surfaces of each of the at least one baffle housing wall (107,103,110,105, 106) using a skirt/sleeve (112).

25. The method of claim 22 further comprising a step of covering the outlet section (109) and the top housing wall (107) of the baffle housing (102) using an outlet sealing cover (114).

26. The method of claim 25, wherein the outlet sealing cover (114) comprises a frame (115) that supports a mesh screen (116) adapted for capturing the debris entering the outlet section (109) of the sound muffler device (100), and one or more flexible vanes (117) attached to and extending from the frame (115) for facilitating the engagement of the outlet sealing cover (114) on top of the sound muffler device (100).

* * * * *